US009550084B2

(12) United States Patent
Fan et al.

(10) Patent No.: US 9,550,084 B2
(45) Date of Patent: Jan. 24, 2017

(54) REMOVAL OF ELEMENTS FROM COAL FLY ASH

(71) Applicant: University of Wyoming, Laramie, WY (US)

(72) Inventors: Maohong Fan, Ames, IA (US); Morris D. Argyle, Provo, UT (US); Mustafa O. M. Sharrad, Western Region (LY)

(73) Assignee: University of Wyoming, Laramie, WY (US)

( * ) Notice: Subject to any disclaimer, the term of this patent is extended or adjusted under 35 U.S.C. 154(b) by 269 days.

(21) Appl. No.: 13/901,533

(22) Filed: May 23, 2013

(65) Prior Publication Data

US 2013/0317274 A1 Nov. 28, 2013

Related U.S. Application Data

(60) Provisional application No. 61/650,851, filed on May 23, 2012.

(51) Int. Cl.

| | |
|---|---|
| ***A62D 3/36*** | (2007.01) |
| ***A62D 3/33*** | (2007.01) |
| *A62D 101/08* | (2007.01) |
| *A62D 101/24* | (2007.01) |
| *A62D 101/43* | (2007.01) |

(52) U.S. Cl.

CPC . *A62D 3/36* (2013.01); *A62D 3/33* (2013.01); *A62D 2101/08* (2013.01); *A62D 2101/24* (2013.01); *A62D 2101/43* (2013.01)

(58) Field of Classification Search

None

See application file for complete search history.

(56) References Cited

U.S. PATENT DOCUMENTS

| | | | | |
|---|---|---|---|---|
| 3,939,070 | A | 2/1976 | Roth | |
| 4,014,787 | A | 3/1977 | Shorr | |
| 4,169,053 | A | 9/1979 | Sakakibara et al. | |
| 4,705,639 | A | 11/1987 | Aldrich | |
| 5,000,859 | A | 3/1991 | Suciu et al. | |
| 5,906,671 | A * | 5/1999 | Weinwurm et al. | 75/479 |
| 6,096,222 | A | 8/2000 | Wurzburger et al. | |
| 6,153,108 | A | 11/2000 | Klock et al. | |
| 6,517,789 | B1 * | 2/2003 | Myerson et al. | 423/101 |
| 2008/0197081 | A1 * | 8/2008 | Gadgil | 210/688 |
| 2009/0022639 | A1 * | 1/2009 | Poijarvi et al. | 423/24 |
| 2013/0092057 | A1 * | 4/2013 | Konishi et al. | 106/819 |
| 2013/0199567 | A1 * | 8/2013 | Tamura et al. | 134/10 |
| 2013/0315804 | A1 * | 11/2013 | Halverson et al. | 423/53 |

OTHER PUBLICATIONS

Ghaly et al., "Treatment of Grease Filter Washwater by Chemical Coagulation," Canadian Biosystems Engineering, ' vol. 48, 2006, pp. 6.13-6.22.

Li-Yang Chang, "Alternative Chromium Reduction and Heavy Metal Precipitation Methods for Industrial Wastewater," Environmental Progress, vol. 22, No. 3, Oct. 2003, pp. 174-182.

Haydar et al., "Characterization and Treatability Studies of Tannery Wastewater Using Chemically Enhanced Primary Treatment (CEPT)—A Case Study of Saddiq Leather Works," Journal of Hazardous Materials, 163, 2009, pp. 1076-1083.

Meng et al., "Effects of Silicate, Sulfate, and Carbonate on Arsenic Removal by Ferric Chloride," Wat. Res., vol. 34, No. 4, pp. 1255-1261, 2000.

James R. Aldrich, "A Better Heavy Metal Waste Treatment Method," Air Force Engineering and Services Laboratory, Tyndall Air Force Base, FL, Pollution Control, pp. 51-55.

Irfan, M., "Superiority of Ferric Chloride as Coagulant Over Alum and Ferrous and Sulphate at Controlled PH and Cost Comparison of these Coagulant," Environmental Sciences, S54, Journal of the Pakistan Institute of Chemical Engineers, vol. 36, Jan. 2008 p. 49.

Donahoe et al., "Chemical Fixation of Trace Elements in Coal Fly Ash," 2007 World of Coal Ash, May 2007, Department of Geological Sciences, pp. 1-17.

Aileen Halverson, "Selenium Leaching from Fly Ash," Dry Sorbent Technology Exchange, May 2011, Scottsdale, Arizona, Pages.

Mustafa Omar M. Sharrad, "Removal of Heavy Metals and Carbonate as well as Bicarbonate," Dissertation, University of Wyoming Oct. 2011, pp. 1-21.

* cited by examiner

*Primary Examiner* — Melissa Swain

(74) *Attorney, Agent, or Firm* — Cochran Freund & Young LLC; Samuel M. Freund

(57) ABSTRACT

A method for removing elements, including heavy metals, from fly ash and from fly ash resulting from removal of $SO_x/NO_x$ from flue gas using $Na_2CO_3/NaHCO_3$/trona, is described. An aqueous suspension of the fly ash and/or a solution of the leachate from the fly ash is treated with dissolved ferrous compounds, such as $FeSO_4.7H_2O$ and/or $FeCl_2.4H_2O$, at a chosen initial acidic pH, and the precipitation of the ferrous ions as the solution basifies sequesters the trace elements.

24 Claims, No Drawings

REMOVAL OF ELEMENTS FROM COAL FLY ASH

RELATED CASES

The present patent application claims the benefit of Provisional Patent Application Ser. No. 61/650,851 filed on 23 May 2012 entitled "Removal Of Heavy Metals From Coal Fly Ash" by Maohong Fan et al., the disclosure and teachings of which are hereby incorporated by reference herein.

FIELD OF THE INVENTION

Embodiments of the present invention relate generally to coal fly ash and, more particularly, to the removal of elements, including heavy metals from coal fly ash and leachates thereof.

BACKGROUND OF THE INVENTION

The production of energy from fossil fuels such as coal, oil and natural gas generates large amounts of gaseous, liquid and solid wastes, including coal fly ash, which typically contains various toxic heavy metals. It is estimated that today more than 600 million tons of coal ash are produced annually, about 500 million tons (75-80%) in the form of airborne fly ash. The industrial utilization of fly ash worldwide today ranges from a minimum of 3% up to a maximum 57%, with an average of 16% of the total fly ash produced. A large amount of coal ash is still disposed of in landfills. Two different techniques are used for ash disposal. In the wet disposal technique, large quantities of fly ash are collected as wet slurry and disposed of in ash ponds. The second technique involves disposing of the ash in dry form as ash mounds.

The disposal of coal ash in ponds and landfills creates environmental problems, including the leaching of heavy and trace elements into ground and surface water. Some of these elements are toxic and cause numerous diseases in plants, animals and humans. Trace and heavy metals from different fly ashes into the environment, including arsenic, barium, beryllium, cadmium, chromium, copper, lead, selenium, vanadium and other hazardous materials can leach from fly ash into the environment. Because of its heavy and trace element content, coal fly ash is an industrial byproduct that is recognized as an environmental pollutant.

Another byproduct of coal-fired power plants is $SO_x/NO_x$ in flue gas, which can have serious negative impact on trees and plants. The abilities of soils in resisting and buffering acidity are determined by the thickness and composition of the soil along with the characteristics of bedrock beneath. Acid rain resulting from flue gas emission damages trees and plants by damaging their leaves, reducing the availability of nutrients, or increasing exposure to harmful substances in the soil. Therefore, the acidic gases in flue gas need to be removed. Conventional $SO_x/NO_x$ removal methods use lime or limestone; however, the kinetics of the reactions between calcium materials (lime/limestone) and $SO_x/NO_x$ is slow. Sodium based materials ($Na_2CO_3NaHCO_3$/trona) can be used to overcome some shortcomings of calcium based $SO_x/NO_x$ removal agents. The difficulty associated with sodium based $SO_x/NO_x$ removal materials is that some trace elements or heavy metals, especially Arsenic (As) and Selenium (Se) in fly ashes become more leachable.

A simple, cost-effective approach for the remediation of fly ash associated with conventional lime-based desulfurization has not been available, since not all of the nonbiodegradable heavy metals can be simultaneously removed under the same conditions. Increasing numbers of coal-fired power plants are using trona for desulfurization; however, the carbonate and bicarbonate introduced into the process by trona makes the heavy metals more leachable and difficult to remove.

Reducing the amount of fly ash released into the environment by taking advantage of its cementitious or binding characteristics for use as a construction material; the chemical remediation of fly ash; exploiting the high alkalinity of fly ash for use as a soil amendment; and removing leachable trace elements using different sorbents, have been proposed for addressing trona-associated coal fly ashes. Due to its high efficiency, ease of operation and the low cost and wide availability of sorbents, adsorption generally has been considered to be a promising technology; however, conventional adsorption technology does not work well such fly ashes, because of the complexity of its leachates.

The concentrations and types of heavy metals in fly ashes vary from one coal to another, such that methods for removal of heavy metals from fly ash likewise vary. Ion exchange, chemical precipitation, reverse osmosis, and solvent extraction have long been studied by many researchers. Nonetheless, it remains difficult to develop a cost-effective method that can simultaneously remove all toxic elements, particularly selenium, from fly ash associated with the use of trona for desulfurization in coal fired power plants.

SUMMARY OF THE INVENTION

Embodiments of the present invention overcome the disadvantages and limitations of prior art by providing a method for removing elements, including heavy metals, from coal fly ash.

Another object of embodiments of the present invention is to provide a method for removing elements, including heavy metals, from coal fly ash that result from the use of $Na_2CO_3$/$NaHCO_3$/trona for desulfurization.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the method for removing at least one element from fly ash, hereof, includes: treating the fly ash with an acidified liquid; allowing the acidified liquid to become basic by reaction with the fly ash; dissolving at least one ferrous compound in the basified liquid, wherein a precipitate of the ferrous compound is formed effective for sequestering the at least one element; and separating the precipitate from the liquid.

In another aspect of the invention and in accordance with its objects and purposes, the method for removing at least one element from fly ash, hereof, includes: treating the fly ash with an acidified liquid comprising at least one soluble ferrous compound; allowing the acidified liquid to become basic by reaction with the fly ash; whereby a precipitate of the ferrous compound is formed effective for sequestering said at least one element; and separating the precipitate from the liquid.

Benefits and advantages of the present invention include, but are not limited to, providing a method for removing potentially hazardous heavy metals from fly ash by sequestration thereof in a precipitate.

DETAILED DESCRIPTION OF THE INVENTION

Briefly, the present invention includes a method for removing trace elements, including heavy metals from fly ash and from fly ash resulting from the removal of $SO_x/NO_x$ from flue gas using $Na_2CO_3/NaHCO_3$/trona. Factors affecting the removal of heavy metals from four fly ash samples generated when $Na_2CO_3/NaHCO_3$/trona is used for removing $SO_x/NO_x$, using soluble ferrous compounds such as $FeSO_4.7H_2O$ and/or $FeCl_2.4H_2O$, including agent dosages, redox time/pH, and precipitation time/pH in the presence of high concentrations of $CO_3^{2-}$, are investigated.

The soluble ferrous compounds, $FeSO_4.7H_2O$ and $FeCl_2.4H_2O$, were investigated for their ability to remove leached trace elements from the leachates of four fly ash samples, as the ferrous ions precipitate from the solution at higher pH values as ferrous hydroxide, and sequester these elements. The results showed that 100% of Arsenic and Vanadium were removed by the lowest dosage of both agents, while Boron levels were not significantly affected by either agent. The element Se showed significant removal by both multifunctional agents, although the $FeCl_2.4H_2O$ demonstrated better performance than $FeSO_4.7H_2O$, with the former removing a higher percentage of Se than the latter at the same dosage level. However, based on its $Fe^{2+}$ content, $FeSO_4.7H_2O$ showed better removal performance than $FeCl_2.4H_2O$. The Se removal percentage for both multifunctional agents was found to increase with increasing levels of the agents. The term "multifunctional agent" is used throughout when referring to these and other ferrous compositions, since they perform two functions: (1) they reduce Se(VI) to Se(IV) with the oxidation of $Fe^{+2}$ to $Fe^{+3}$, which can be precipitated at higher pH values; and (2) form precipitates themselves at higher pH values effective for sequestering elements in the solution, including heavy metals. Varying redox time, redox pH, precipitation time, and precipitation pH, showed no significant effect for two of the fly ash samples.

The efficiencies of the multifunctional agents were affected by leachate pH at high leachate pH values. The results indicate that the efficiency of element removal from the fly ash was high at low initial leachate pH (that is, after acidification to a pH of about 2, as an example), and required low dosages of the multifunctional agent. By contrast, efficiency was lower at the original pH of the leachate than at the lower pH, thus requiring higher multifunctional agent dosage and longer removal time; that is, whereas 13 g/L multifunctional agent removed about 98% of all trace and heavy elements present in the leachate after about four hours for F4 at low pH, the same removal percentage was realized at high leachate pH only after five weeks.

In what follows, all chemical solutions were prepared using deionized water and analytical grade chemicals. $FeSO_4.7H_2O$ was purchased from Sigma-Aldrich; $FeCl_2.4H_2O$ was purchased from Alfa-Aesar, and $HNO_3$ and NaOH were used for pH adjustments. Concentrations of trace elements were measured using an Inductively Couple Plasma Optical Emission Spectrometer (ICP-OES).

A. Characterization of Fly Ash:

Four fly ash samples, F1-F4, were characterized for their physical and chemical properties The surface areas of F1-F4, were, respectively, 1.52 $m^2/g$, 0.15 $m^2/g$, 2.42 $m^2/g$ and 0.37 $m^2/g$, as shown in TABLE 1. The pore volumes and average pore diameters are also shown therein. The physical characteristics (BET surface area, pore volume and diameter) of fly ashes are expected to affect their leaching properties, as will be discussed hereinbelow.

TABLE 1

| Fly Ash | Surface Area ($m^2/g$) | Pore Volume ($cm^3/g$) | Avg. Pore Diameter (μm) |
|---|---|---|---|
| F1 | 3.55 | 0.999 | 1.125 |
| F2 | 2.941 | 0.7618 | 1.036 |
| F3 | 3.431 | 0.637 | 0.7422 |
| F4 | 0.125 | 0.324 | 10.3 |

The concentrations of major elements in the digested fly ash samples are given in TABLE 2.

TABLE 2

| | Concentration (g/kg) | | | | | |
|---|---|---|---|---|---|---|
| Fly ash | Na | Mg | Ca | Si | Fe | Al |
| DL (ig/L)* | 0.01 | 0.01 | 0.01 | 1 | 1 | 0.1 |
| F1 | 190.93 | 3.22 | 9.91 | 317.66 | 66.83 | 78.69 |
| F2 | 202.25 | 3.02 | 8.24 | 341.76 | 52.99 | 68.53 |
| F3 | 215.80 | 5.10 | 169.49 | 332.71 | 8.26 | 38.91 |
| F4 | 50.75 | 4.34 | 134.01 | 318.67 | 105.01 | 134.63 |

D L*: Detection limit

TABLE 2 shows that all fly ash samples contain high Si with a concentration range of 317.66 to 332.71 g/kg with Na representing the second highest concentration in all samples, but in F4, Na is not as high as in the other three samples. Mg has the lowest concentration of the six elements studied, with values ranging from 3.02 to 5.10 g/kg. The concentrations of Ca, Fe and Al vary considerably from one fly ash sample to another; e.g., the concentration of Fe in F3 is only 8.26 g/kg, while 1 kg F4 contains 105.01 g Fe.

Trace elements were measured for the four fly ash samples, as provided in TABLE 3.

TABLE 3

| Trace Elements (mg/kg) | F1 | F2 | F3 | F4 | MRL* |
|---|---|---|---|---|---|
| As | 47.9 | 50.6 | 3.99 | 23.2 | 0.005 |
| Be | 1.8 | 1.66 | 1.32 | 1.14 | 0.005 |
| B | 183 | 172 | 100 | 143 | 0.005 |
| Cd | 0.23 | 0.32 | 0.37 | 0.2 | 0.005 |
| Cr | 5.84 | 4.65 | 5.09 | 14.6 | 0.005 |
| Co | 1.94 | 1.81 | 2.40 | 2.34 | 0.005 |
| Cu | 5.75 | 5.67 | 16.2 | 11.9 | 0.005 |
| Pb | 5.74 | 5.88 | 4.73 | 5.54 | 0.005 |
| Hg | 0.152 | 0.150 | 0.133 | 0.145 | 0.005 |
| Ni | 7.10 | 6.10 | 4.93 | 4.37 | 0.005 |
| Se | 9.54 | 3.30 | 1.59 | 8.49 | 0.005 |
| Ag | 0.15 | 0.14 | 0.17 | 0.07 | 0.005 |
| V | 30.2 | 29.3 | 22 | 25.1 | 0.005 |
| Zn | 10.2 | 11.7 | 23.2 | 9.73 | 0.005 |

*Minimum reporting limit

Although considerable variation of trace element concentrations was found among the four fly ash samples, the general trend still obtains: B, As and V are the most abundant elements, while cadmium is the least abundant, with concentrations varying from 0.2 to 0.37 mg/kg. All measured trace elements account for 0.031%, 0.029%, 0.019% and 0.025%, of the fly ash samples F1, F2, F3 and F4, respectively.

The dissolvable anions and $Na^+$ for all fly ash sample F1-F4 were measured and the results are listed in TABLE 4.

TABLE 4

| Sample Number | $Na^+$ (mg/g) | $SO_4^{2-}$ (mg/g) | $NO_3^-$ (mg/g) | $Cl^-$ (mg/g) | $SO_3^{2-}$ (mg/g) | $CO_3^{2-}$ (as $CaCO_3$ (mg/g)) | $HCO_3^-$ | $OH^-$ |
|---|---|---|---|---|---|---|---|---|
| F1 | 170 | 88 | 2.0 | 4.70 | 9.0 | 286 | 3 | 0 |
| F2 | 190 | 71 | 1.74 | 3.60 | 24.0 | 295 | 66 | 0 |
| F3 | 186 | 120 | 0.110 | 0.67 | 28.0 | 108 | 0 | 196 |
| F4 | 36 | 43 | 0.134 | 2.10 | 40.0 | 18 | 22 | 0 |

UD: undetectable

TABLE 4 shows the concentrations of dissolvable anions and $Na^+$ of the four fly ash samples. F4 has the lowest values of dissolvable anions and $Na^+$.

B. Leaching:

The leachable components of four fly ashes (F1-F4) were analyzed based on EPA method 1312. The heavy metal extraction procedures were realized by using an end-over-end agitation method. 100 g fly ash was added to 1 L DI water (pH 5.0±0.1) for 24 h and was stirred at the rate of 30 rpm. The pH values of water were adjusted by using 60:40 weight-ratio mixture of sulfuric acid and nitric acid. After each extraction, the resultant mixture was then filtered through a 0.7 μm glass fiber filter. Each fly ash sample was tested three times. The concentrations of major leachable trace elements in the four fly ashes were analyzed using EPA method 3010/6020. TABLE 5 shows the leachable major elements from the fly ash samples F1-F4, while TABLE 6 shows the leachable trace and heavy elements from the fly ash samples. Additional details regarding these measurements may be found In "Removal Of Heavy Metals And Carbonate As Well As Bicarbonate" by Mustafa Omar Sharrad, A dissertation submitted to the University of Wyoming in partial fulfillment of the requirements for the degree of Ph.D. in Petroleum Engineering, 11 Oct. 2011, the entire disclosure and teachings of which are hereby incorporated by reference herein.

TABLE 5

| | Concentration g/kg | | | | | |
|---|---|---|---|---|---|---|
| Fly ash | Na | Mg | Ca | Si | Fe | Al |
| DL (μg/L)* | | 0.00001 | 0.00001 | 0.001 | 0.001 | 0.0001 |
| F1 | 191.1 | 0.0073 | 0.1041 | 0.3472 | 0.0047 | 0.0437 |
| F2 | 202.6 | 0.1845 | 0.1353 | 0.0162 | 0.0337 | 0.0303 |
| F3 | 225.03 | 0.00056 | 0.1067 | 0.9410 | 0.0053 | 4.170 |
| F4 | 28.4 | 0.0112 | 0.0821 | 0.0273 | 0.0076 | 0.1377 |

D L*: Detection limit

TABLE 6

| Trace Elements (mg/kg) | F1 | F2 | F3 | F4 |
|---|---|---|---|---|
| Ag | 0.000 | 0.000 | 0.000 | 0.000 |
| As | 65.53 | 54.41 | 4.295 | 12.520 |
| B | 97.04 | 86.29 | 52.415 | 59.495 |
| Ba | 0.91 | 1.39 | 0.700 | 0.430 |
| Be | 0.000 | 0.000 | 0.015 | 0.000 |
| Cd | 0.000 | 0.000 | 0.000 | 0.000 |
| Co | 0.02 | 0.18 | 0.005 | 0.010 |

TABLE 6-continued

| Trace Elements (mg/kg) | F1 | F2 | F3 | F4 |
|---|---|---|---|---|
| Cr | 1.245 | 0.865 | 1.590 | 1.405 |
| Cu | 0.035 | 0.26 | 0.085 | 0.025 |
| Mn | 0.000 | 0.05 | 0.015 | 0.000 |
| Ni | 0.000 | 0.235 | 0.005 | 0.000 |
| Pb | 0.000 | 0.000 | 0.000 | 0.000 |
| Se | 6.26 | 4.68 | 3.045 | 10.055 |
| V | 14.96 | 11.57 | 17.715 | 7.135 |
| Zn | 0.05 | 0.075 | 1.675 | 0.060 |

To determine the effect of the initial water pH on the final leachate pH and the trace element leachability, the four fly ash samples F1-F4 were exposed to pH values 5.0, 10.0, 11.0, 12.0, and 13.0±0.05. The final pH of the filtered solution was measured directly after filtration, with results shown in TABLE 7. It should be mentioned that the final pH of the leachate rises while in contact with the fly ash because of the carbonate/bicarbonate and trona composition of the fly ash.

TABLE 7

| | Final pH (Filtrate Solution pH) | | | |
|---|---|---|---|---|
| $pH_{il}$ | F1 | F2 | F3 | F4 |
| 5 | 11.14 | 10.12 | 13.17 | 10.27 |
| 10 | 11.19 | 10.13 | 13.20 | 10.29 |
| 11 | 11.23 | 10.13 | 13.26 | 10.36 |
| 12 | 11.78 | 10.29 | 13.32 | 11.44 |
| 13 | 12.89 | 12.21 | 13.39 | 12.99 |

All values are averages of two runs

TABLE 7 shows the effects of pH of the filtered solution on initial $pH_{il}$. From this TABLE it may be observed that the pH of the leachate did not change significantly when the initial water pH increased from 5.0 to 11.0. However, when initial water pH rose above 11.0, the final leachate pH increased significantly for all fly ash samples with the exception of F3, in which no significant effect was noticed.

TABLES 8-11 illustrate the effect of initial water pH on the leachability of trace elements from fly ash samples F1, F2, F3 and F4, respectively.

TABLE 8

| Trace Elements | pH | | | | |
|---|---|---|---|---|---|
| (mg/kg) | 5.0 | 10.0 | 11.0 | 12.0 | 13.0 |
| Ag | 0 | 0.005 | 0.005 | 0.005 | 0.01 |
| As | 65.53 | 61.6 | 63.665 | 65.815 | 74.43 |
| B | 97.04 | 86.585 | 89.7 | 92.74 | 121.5 |
| Ba | 0.91 | 0.875 | 0.885 | 0.765 | 0.83 |
| Be | 0 | 0 | 0 | 0 | 0.105 |
| Cd | 0 | 0 | 0 | 0 | 0 |
| Co | 0.02 | 0.02 | 0.02 | 0.015 | 0.01 |

TABLE 8-continued

| Trace Elements (mg/kg) | pH 5.0 | pH 10.0 | pH 11.0 | pH 12.0 | pH 13.0 |
|---|---|---|---|---|---|
| Cr | 1.245 | 1.17 | 1.19 | 1.27 | 1.385 |
| Cu | 0.035 | 0.03 | 0.03 | 0.025 | 0.06 |
| Mn | 0 | 0 | 0 | 0 | 0.035 |
| Ni | 0 | 0.005 | 0 | 0 | 0 |
| Pb | 0 | 0 | 0 | 0 | 0.08 |
| Se | 6.26 | 5.775 | 5.95 | 5.755 | 6.13 |
| V | 14.96 | 13.755 | 14.325 | 15.505 | 22.23 |
| Zn | 0.05 | 0.08 | 0.23 | 0.04 | 0.44 |

TABLE 8 shows no significant effect from initial water pH on the leachability of trace elements from sample F1 when pH was increased from 5.0 to 12.0. However, when pH reached 13.0, the leachability of arsenic, boron, beryllium, vanadium and zinc increased significantly. Also, except for concentrations of As, Cr and Se, the concentrations of trace and heavy metals in the F1 leachates at pH ≤12.0 were below acceptable concentrations, while the concentrations of As, Be, Cr, Pb and Se at pH 13.0 were above acceptable concentrations.

TABLE 9

| Trace Elements (mg/kg) | pH 5.0 | pH 10.0 | pH 11.0 | pH 12.0 | pH 13.0 |
|---|---|---|---|---|---|
| Ag | 0 | 0 | 0 | 0 | 0 |
| As | 54.41 | 50.773 | 51.9 | 51.025 | 64.825 |
| B | 86.29 | 76.643 | 77.26 | 76.83 | 102.93 |
| Ba | 1.39 | 1.203 | 1.195 | 1.13 | 0.945 |
| Be | 0 | 0 | 0 | 0 | 0.015 |
| Cd | 0 | 0 | 0 | 0 | 0 |
| Co | 0.18 | 0.177 | 0.175 | 0.163 | 0.01 |
| Cr | 0.865 | 0.857 | 0.85 | 0.875 | 1.04 |
| Cu | 0.26 | 0.247 | 0.275 | 0.225 | 0.02 |
| Mn | 0.05 | 0.057 | 0.05 | 0.045 | 0.01 |
| Ni | 0.235 | 0.237 | 0.24 | 0.21 | 0 |
| Pb | 0 | 0 | 0 | 0 | 0 |
| Se | 4.68 | 4.187 | 4.34 | 4.42 | 4.6615 |
| V | 11.57 | 10.94 | 11.14 | 11.295 | 15 |
| Zn | 0.075 | 0.087 | 0.14 | 0.095 | 0.075 |

TABLE 9 shows that the effect of initial water pH on the leachability of trace elements in sample F2 was insignificant when the initial pH was increased from 5.0 to 11.0. However, the leachability of As, B, Cr and V increased significantly, and the leachability of Cu and Ni decreased significantly when initial pH was increased from 12.0 to 13.0.

TABLE 10

| Trace Elements (mg/kg) | pH 5.0 | pH 10.0 | pH 11.0 | pH 12.0 | pH 13.0 |
|---|---|---|---|---|---|
| Ag | 0 | 0 | 0 | 0 | 0 |
| As | 4.295 | 3.687 | 4.055 | 4.140 | 4.240 |
| B | 52.415 | 26.635 | 45.445 | 46.595 | 50.405 |
| Ba | 0.700 | 0.700 | 0.730 | 0.740 | 0.640 |
| Be | 0.015 | 0.017 | 0.015 | 0.015 | 0.020 |
| Cd | 0 | 0 | 0 | 0 | 0 |
| Co | 0.005 | 0.003 | 0.005 | 0.005 | 0.005 |
| Cr | 1.590 | 1.383 | 1.460 | 1.490 | 1.520 |
| Cu | 0.085 | 0.077 | 0.105 | 0.090 | 0.120 |
| Mn | 0.015 | 0.013 | 0.015 | 0.015 | 0.010 |
| Ni | 0.005 | 0.000 | 0.005 | 0.005 | 0.005 |
| Pb | 0 | 0 | 0 | 0 | 0 |

TABLE 10-continued

| Trace Elements (mg/kg) | pH 5.0 | pH 10.0 | pH 11.0 | pH 12.0 | pH 13.0 |
|---|---|---|---|---|---|
| Se | 3.045 | 2.497 | 2.930 | 2.895 | 3.310 |
| V | 17.715 | 15.793 | 17.095 | 17.320 | 16.700 |
| Zn | 1.675 | 1.407 | 1.683 | 1.635 | 2.605 |

By contrast, results for F3 (TABLE 10) show that initial pH below 12.0 had no effect on trace elements with the exception of zinc, whose leachability increased significantly when initial pH was increased from 12.0 to 13.0. In F3 as in F1, except for concentrations of As, Cr and Se, the concentrations of trace and heavy metals in the leachates at pH ≤12.0 were below acceptable concentrations, while at pH 13.0 As, Be, Cr and Se were above the acceptable concentrations.

TABLE 11

| Trace Elements (mg/kg) | pH 5.0 | pH 10.0 | pH 11.0 | pH 12.0 | pH 13.0 |
|---|---|---|---|---|---|
| Ag | 0 | 0 | 0 | 0 | 0 |
| As | 12.520 | 11.790 | 12.650 | 16.120 | 21.850 |
| B | 59.495 | 54.823 | 58.875 | 62.475 | 70.840 |
| Ba | 0.430 | 0.463 | 0.480 | 0.405 | 1.260 |
| Be | 0 | 0 | 0 | 0 | 0 |
| Cd | 0 | 0 | 0 | 0 | 0 |
| Co | 0.010 | 0.010 | 0.010 | 0.010 | 0.005 |
| Cr | 1.405 | 1.397 | 1.475 | 1.745 | 1.440 |
| Cu | 0.025 | 0.023 | 0.020 | 0.020 | 0.055 |
| Mn | 0 | 0.000 | 0 | 0.005 | 0 |
| Ni | 0 | 0.003 | 0.005 | 0.005 | 0.005 |
| Pb | 0 | 0 | 0 | 0 | 0 |
| Se | 10.055 | 8.977 | 10.065 | 9.910 | 11.455 |
| V | 7.135 | 6.550 | 7.315 | 9.340 | 10.405 |
| Zn | 0.060 | 0.063 | 0.030 | 0.045 | 0.235 |

TABLE 11 shows no significant effect on the leachability of trace elements in the samples when initial water pH was increased from 5.0 to 12.0, but significant leachability of arsenic, boron, barium, selenium, vanadium and zinc upon reaching 13.0. For F3 and F4, the concentrations of the trace and heavy metals in the leachates at all pH values tested were below the allowable concentrations, except for concentrations of As, Cr and Se.

The effect of temperature change on the leachability of trace elements from the four fly ash samples was studied at two settings, room temperature (23.0° C.±2.0° C.) and a cooler setting (9.0° C.±2.0° C.), and at two different initial water pH values (5.0 and 10.0). The results are shown below in TABLE 12.

TABLE 12

| Trace elements (mg/kg) | pH 5.0 F1 23° C. | pH 5.0 F1 8° C. | pH 5.0 F2 23° C. | pH 5.0 F2 8° C. | pH 10.0 F1 23° C. | pH 10.0 F1 8° C. | pH 10.0 F2 23° C. | pH 10.0 F2 8° C. |
|---|---|---|---|---|---|---|---|---|
| Ag | 0 | 0 | 0 | 0 | 0 | 0 | 0 | 0 |
| As | 65.530 | 57.530 | 54.410 | 49.345 | 61.600 | 56.755 | 52.305 | 52.140 |
| B | 97.040 | 95.490 | 86.290 | 82.665 | 86.585 | 93.155 | 77.895 | 82.230 |
| Ba | 0.910 | 0.720 | 1.390 | 1.117 | 0.875 | 0.835 | 1.190 | 1.250 |
| Be | 0 | 0 | 0 | 0 | 0 | 0 | 0 | 0 |
| Cd | 0 | 0 | 0 | 0 | 0 | 0 | 0 | 0 |
| Co | 0.020 | 0.040 | 0.180 | 0.160 | 0.020 | 0.035 | 0.180 | 0.180 |
| Cr | 1.140 | 1.050 | 0.870 | 0.915 | 1.065 | 1.050 | 0.803 | 0.830 |
| Cu | 0.035 | 0.035 | 0.260 | 0.235 | 0.030 | 0.030 | 0.245 | 0.230 |
| Mn | 0 | 0 | 0.050 | 0.130 | 0 | 0 | 0.053 | 0.150 |
| Ni | 0 | 0.005 | 0.235 | 0.260 | 0.005 | 0.005 | 0.235 | 0.260 |
| Pb | 0 | 0 | 0 | 0 | 0 | 0 | 0 | 0 |
| Se | 6.260 | 6.130 | 4.680 | 4.585 | 5.775 | 6.105 | 4.380 | 4.920 |
| V | 14.955 | 11.840 | 11.570 | 10.205 | 13.755 | 12.050 | 11.180 | 10.690 |
| Zn | 0.050 | 0.015 | 0.075 | 0.115 | 0.080 | 0.035 | 0.078 | 0.240 |

TABLE 12 shows a slight effect on the leachability of trace elements from fly ash samples due to a change in leaching temperature, with the higher temperature favored at pH 5.0. There was no effect at pH 10.0, although the leachability of B, Se and Zn increased with temperature within the range tested.

C. Reduction and Adsorption at low pH:

$FeSO_4.7H_2O$ and $FeCl_2.4H_2O$, two multifunctional agents, were used for the exploring adsorption, at room temperature (23° C.±2° C.). Two samples from each fly ash leachate were used for adsorption testing by the two types of multifunctional agents, and each test was conducted twice.

1. Treatment with $FeSO_4.7H_2O$:

TABLE 13 shows the results at a randomly chosen $FeSO_4.7H_2O$ dosage (9.0 g/L), at room temperature of (23° C.±2° C.).

TABLE 13

| | Removal % F1 | F2 | F3 | F4 |
|---|---|---|---|---|
| Ag | | | | |
| As | 100.0 | 99.2 | 100.0 | 100.0 |
| B | 16.5 | 20.0 | 11.3 | 12.5 |
| Ba | 100.0 | 29.5 | 100.0 | 100.0 |
| Be | | | 100.0 | |
| Cd | | | | |
| Co | 100.0 | 100.0 | 35.5 | 100.0 |
| Cr | 80.2 | 100.0 | 65.2 | 84.0 |
| Cu | 100.0 | 100.0 | 100.0 | 100.0 |
| Mn | | | | |
| Ni | | 100.0 | 100.0 | |
| Pb | | | | |
| Se | 52.6 | 79.6 | 65.9 | 91.9 |
| V | 100.0 | 100.0 | 97.8 | 100.0 |
| Zn | 100.0 | 91.6 | 100.0 | 100.0 |

Different $FeSO_4.7H_2O$ dosages were used to study the effects of multifunctional agent dosage on the reduction of trace elements leached from the fly ash samples, with the results being illustrated in the following TABLES.

For fly ash sample F1, 9.0, 11.0, 13, and 18 g/L of $FeSO_4.7H_2O$ were used to investigate the influence of the dosage of $FeSO_4.7H_2O$ on reduction of trace and heavy metals from the leachate. The results are set forth in TABLE 14.

TABLE 14

| Trace Elements | Removal % $FeSO_4 \bullet 7H_2O$ dosage (g/L) 9.0 | 11.0 | 13.0 | 18.0 |
|---|---|---|---|---|
| Ag | | | | |
| As | 100.0 | 100.0 | 100.0 | 100.0 |
| B | 16.5 | 26.4 | 26.2 | 38.0 |
| Ba | 100.0 | 100.0 | 100.0 | 100.0 |
| Be | | | | |
| Cd | | | | |
| Co | 100.0 | 100.0 | 100.0 | 100.0 |
| Cr | 80.2 | 76.4 | 65.7 | 92.7 |
| Cu | 100.0 | 100.0 | 100.0 | 100.0 |
| Mn | | | | |
| Ni | | | | |
| Pb | | | | |
| Se | 52.6 | 67.5 | 72.4 | 94.8 |
| V | 100.0 | 100.0 | 100.0 | 100.0 |
| Zn | 100.0 | 100.0 | 100.0 | 100.0 |

As may be observed from TABLE 14, 100% of arsenic, copper and vanadium were removed from fly ash sample F1 by the lowest dosage (9.0 g/L), while the percentage of selenium removed increased with an increasing dosage of multifunctional agent.

Three different $FeSO_4.7H_2O$ dosage 9.0, 11.0, and 13 g/L were used to investigate the effect of different multifunctional $FeSO_4.7H_2O$ dosage on removal of trace and heavy metals from leachate of fly ash sample F2. The results are set forth in TABLE 15.

TABLE 15

| Trace Elements | Removal % $FeSO_4 \bullet 7H_2O$ dosage (g/L) 9.0 | 11.0 | 13.0 |
|---|---|---|---|
| Ag | | | |
| As | 100.0 | 100.0 | 100.0 |
| B | 11.3 | 17.1 | 16.1 |
| Ba | 100.0 | 100.0 | 100.0 |
| Be | | | |
| Cd | | | |
| Co | 35.5 | 30.6 | 100.0 |
| Cr | 65.2 | 49.3 | 100.0 |
| Cu | 100.0 | 100.0 | 100.0 |
| Mn | −55,677.8 | −66,705.6 | −87,261.1 |
| Ni | 100.0 | 100.0 | 100.0 |

TABLE 15-continued

| Trace | Removal % $FeSO_4 \cdot 7H_2O$ dosage (g/L) | | |
|---|---|---|---|
| Elements | 9.0 | 11.0 | 13.0 |
| Pb | | | |
| Se | 65.9 | 76.6 | 79.0 |
| V | 97.8 | 98.2 | 99.1 |
| Zn | 100.0 | 100.0 | 100.0 |

As may be seen from TABLE 15, 100% of As, Ba, Cu, Ni, V and Zn were removed by the lowest multifunctional agent dosage (9.0 g/L), while Se removal increased with an increase in multifunctional agent dosage. Co, and Cr were removed totally (100%) at the highest dosage used 13 g/L.

The three $FeSO_4.7H_2O$ dosages, 9.0, 11.0, and 13 g/L, used for fly ash sample F2, were also used for treatment of F3 leachate and the obtained results are listed in TABLE 16.

TABLE 16

| | Removal % $FeSO_4 \cdot 7H_2O$dosage (g/L) | | |
|---|---|---|---|
| Trace Elements | 9.0 | 11.0 | 13.0 |
| Ag | | | |
| As | 99.2 | 100.0 | 100.0 |
| B | 20.0 | 34.3 | 35.4 |
| Ba | 29.5 | 23.9 | 21.4 |
| Be | 91.7 | 93.0 | 100.0 |
| Cd | | | |
| Co | | | |
| Cr | 100.0 | 100.0 | 93.4 |
| Cu | 100.0 | 100.0 | 100.0 |
| Mn | −24,840.9 | −63,945.5 | −103,627.3 |
| Ni | | | |
| Pb | | | |
| Se | 79.6 | 92.6 | 95.6 |
| V | 100.0 | 100.0 | 100.0 |
| Zn | 91.6 | 88.9 | 83.6 |

Results for fly ash sample F3 in TABLE 16 show that As, Cr, Cu, Ni and V were completely removed at the lowest multifunctional agent dosage, while Be, and Se removal efficiency increased with an increase in multifunctional agent dosage, reaching about 96% and 100% at 13.0 g/L of $FeSO_4.7H_2O$ for Se, Be respectively.

The effects of five $FeSO_4.7H_2O$ dosages (7.5, 9.0, 10.5, 11, and 13 g/L) on the removal of trace and heavy metals from the leachate of fly ash sample F4 were investigated with the results illustrated in Table 17.

TABLE 17

| Trace | Removal % $FeSO_4 \cdot 7H_2O$ dosage (g/L) | | | | |
|---|---|---|---|---|---|
| Elements | 7.5 | 9.0 | 10.5 | 11.0 | 13.0 |
| Ag | | | | | |
| As | 100.0 | 100.0 | 100.0 | 100.0 | 100.0 |
| B | 10.3 | 12.5 | 10.3 | 17.9 | 19.2 |
| Ba | 100.0 | 100.0 | 100.0 | 100.0 | 100.0 |
| Be | | | | | |
| Cd | | | | | |
| Co | 100.0 | 100.0 | 100.0 | 100.0 | 100.0 |
| Cr | 42.9 | 84.0 | 70.0 | 74.2 | 74.5 |
| Cu | 100.0 | 100.0 | 100.0 | 100.0 | 100.0 |
| Mn | | | | | |
| Ni | | | | | |
| Pb | | | | | |
| Se | 85.3 | 91.9 | 93.7 | 97.1 | 98.0 |
| V | 99.9 | 100.0 | 100.0 | 100.0 | 100.0 |
| Zn | 100.0 | 100.0 | 100.0 | 100.0 | 100.0 |

From TABLE 17, it may be observed that 100% of As, Co, Cu, V and Zn were removed by the lowest dosage (7.5 g/L), while the removal of Cr, and Se increased with an increase in $FeSO_4.7H_2O$ dosage, from about 43% at 7.5 g/L to about 75% at 13 g/L for Cr, and 85.3% at 7.5 g/L $FeSO_4.7H_2O$ to 98% at 13.0 g/L for Se. The negative removal percentages of manganese (Mn) shown in TABLE 17 indicate that Mn was leached from the multifunctional agent.

Fly ash samples F2 and F4 were used to study the effects of redox time and pH, and precipitation time and pH, since they contained high and low carbonate concentrations, respectively.

The effect of $FeSO_4.7H_2O$ redox time was tested over various time periods at conditions of 8.0 g/L $FeSO_4.7H_2O$, redox pH of 2.0, precipitation pH of 8.0, and 1.0 h precipitation time. TABLE 18 illustrates results from sample F2, and TABLE 19 illustrates results from sample F4.

TABLE 18

| Trace | Removal % | | | | |
|---|---|---|---|---|---|
| Elements | 0.5 hour | 1.0 hour | 1.5 hours | 2.0 hours | 3.0 hours |
| Ag | | | | | |
| As | 100.0 | 100.0 | 100.0 | 100.0 | 100.0 |
| B | 20.5 | 18.5 | 20.2 | 17.9 | 18.5 |
| Ba | 100.0 | 100.0 | 100.0 | 100.0 | 100.0 |
| Be | | | | | |
| Cd | | | | | |
| Co | | | | | |
| Cr | 87.2 | 88.5 | 86.1 | 85.3 | 87.0 |
| Cu | 100.0 | 100.0 | 100.0 | 100.0 | 100.0 |
| Mn | −63,210.3 | −60,210.3 | −65,106.9 | −65,555.2 | −65,555.2 |
| Ni | | | | | |
| Pb | | | | | |
| Se | 38.1 | 39.6 | 39.7 | 41.4 | 45.4 |
| V | 100.0 | 100.0 | 100.0 | 100.0 | 100.0 |
| Zn | 100.0 | 100.0 | 100.0 | 100.0 | 100.0 |

TABLE 19

| | Removal % | | | | |
|---|---|---|---|---|---|
| Trace Elements | 0.5 hour | 1.0 hour | 1.5 hours | 2.0 hours | 3.0 hours |
| Ag | | | | | |
| As | 100.0 | 100.0 | 100.0 | 99.8 | 100.0 |
| B | 10.5 | 9.9 | 8.8 | 9.3 | 11.7 |
| Ba | 100.0 | 100.0 | 100.0 | 100.0 | 100.0 |
| Be | | | | | |

TABLE 19-continued

| Trace Elements | Removal % | | | | |
|---|---|---|---|---|---|
| | 0.5 hour | 1.0 hour | 1.5 hours | 2.0 hours | 3.0 hours |
| Cd | | | | | |
| Co | | | | | |
| Cr | 68.2 | 65.6 | 94.7 | 95.5 | 96.5 |
| Cu | 100.0 | 100.0 | 100.0 | 100.0 | 100.0 |
| Mn | −1,525,900.0 | −1,544,900.0 | −696,600.0 | −644,200.0 | −590,500.0 |
| Ni | 100.0 | 100.0 | 100.0 | 100.0 | 56.3 |
| Pb | | | | | |
| Se | 78.6 | 79.5 | 69.6 | 70.3 | 82.1 |
| V | 100.0 | 100.0 | 99.9 | 99.9 | 99.9 |
| Zn | 0.0 | 0.0 | 58.5 | 67.6 | 66.8 |

TABLE 18 shows a slight effect on removal efficiency by redox time for sample F2 as well as sample F4, while TABLE 19 shows that redox time has no significant effect on the removal efficiency for most the trace elements.

In addition, the effects of redox pH on the performance of $FeSO_4.7H_2O$ was studied under the conditions of 8.0 g/L for sample F2 and 6.0 g/L for F4 at 2.0 h redox time, 8.0 precipitation pH, and 1.0 h precipitation time. TABLE 20 show results for F2, and TABLE 21 for F4.

TABLE 20

| Trace Elements | Removal % | | | | |
|---|---|---|---|---|---|
| | pH 1.0 | pH 2.0 | pH 3.0 | pH 4.0 | pH 5.0 |
| Ag | | | | | |
| As | 100.0 | 100.0 | 100.0 | 99.8 | 100.0 |
| B | 5.2 | 4.8 | 4.1 | 3.5 | 4.3 |
| Ba | 100.0 | 100.0 | 100.0 | 100.0 | 100.0 |
| Be | | | | | |
| Cd | | | | | |
| Co | 29.8 | 56.7 | 57.9 | 72.5 | 66.9 |
| Cr | 51.4 | 78.3 | 78.1 | 91.8 | 83.4 |
| Cu | 100.0 | 100.0 | 100.0 | 100.0 | 100.0 |
| Mn | −35,169.2 | −30,515.4 | −32,400.0 | −29,496.2 | −32,803.8 |
| Ni | 100.0 | 100.0 | 100.0 | 100.0 | 100.0 |
| Pb | | | | | |
| Se | 42.3 | 42.6 | 46.8 | 47.5 | 45.9 |
| V | 97.9 | 97.6 | 97.5 | 97.3 | 97.4 |
| Zn | 100.0 | 100.0 | 100.0 | 100.0 | 100.0 |

TABLE 21

| Trace Elements | Removal % | | | | |
|---|---|---|---|---|---|
| | pH 1.0 | pH 2.0 | pH 3.0 | pH 4.0 | pH 5.0 |
| Ag | | | | | |
| As | 100.0 | 100.0 | 100.0 | 100.0 | 100.0 |
| B | 7.8 | 6.4 | 4.1 | 4.4 | 5.4 |
| Ba | 100.0 | 100.0 | 100.0 | 100.0 | 100.0 |
| Be | | | | | |
| Cd | | | | | |
| Co | | | | | |
| Cr | 90.0 | 81.7 | 98.9 | 99.3 | 99.3 |
| Cu | 100.0 | 100.0 | 100.0 | 100.0 | 100.0 |
| Mn | | | | | |
| Ni | | | | | |
| Pb | | | | | |
| Se | 72.9 | 69.1 | 71.8 | 81.4 | 75.0 |
| V | 100.0 | 100.0 | 99.5 | 99.6 | 99.5 |
| Zn | 100.0 | 100.0 | 100.0 | 100.0 | 100.0 |

Five redox pH values were tested on fly ash samples F2 and F4. TABLE 20 illustrates the results from sample F2. Redox pH did not significantly affect As, Cu, Se and V, while Co and Cr removal efficiencies improved after increasing redox pH from 1.0 to 4.0. (Removal efficiency decreased at pH 5.0.) TABLE 21 illustrates the results from fly ash sample F4, in which no trace elements were significantly affected by change of redox pH.

Five precipitation pH values from 5.0 to 9.0 were tested on fly ash samples F2 and F4 to study their effects on the ability of $FeSO_4.7H_2O$ to remove trace elements at 8.0 g/L for F2 and 6.0 g/L for F4, both under 2.0 hours redox time, 2.0 redox pH, and 1.0 hour precipitation.

TABLE 22

| Trace Elements | Removal % | | | | |
|---|---|---|---|---|---|
| | pH 5.0 | pH 6.0 | pH 7.0 | pH 8.0 | pH 9.0 |
| Ag | | | | | |
| As | 100.0 | 100.0 | 100.0 | 99.8 | 99.9 |
| B | 0 | 0 | 0 | 5.8 | 2.7 |
| Ba | 100.0 | 100.0 | 100.0 | 100.0 | 100.0 |
| Be | | | | | |
| Cd | | | | | |
| Co | | | | | |
| Cr | 100.0 | 100.0 | 100.0 | 100 | 73.7 |
| Cu | 100.0 | 100.0 | 100.0 | 100.0 | 100.0 |
| Mn | −44,496.2 | −44,630.8 | −45,361.5 | −36,553.8 | −18,800.0 |
| Ni | 79.6 | 86.2 | 89.8 | 100.0 | 97.8 |
| Pb | | | | | |
| Se | 28.0 | 28.0 | 24.9 | 53.1 | 75.2 |
| V | 97.5 | 99.3 | 99.1 | 97.7 | 97.1 |
| Zn | 100.0 | 100.0 | 100.0 | 80.0 | 23.1 |

TABLE 22 shows results for F2, and TABLE 23 shows the F4 results. TABLE 22 shows that the percentage of Se and Ni removed from fly ash sample F2 increased with an increase in precipitation pH, while As, Cu and V removal percentages were not affected.

TABLE 23

| Trace Elements | Removal % | | | | |
|---|---|---|---|---|---|
| | pH 5.0 | pH 6.0 | pH 7.0 | pH 8.0 | pH 9.0 |
| Ag | | | | | |
| As | 100.0 | 100.0 | 100.0 | 100.0 | 100.0 |
| B | 5.4 | 5.5 | 3.8 | 2.3 | 4.3 |
| Ba | 100.0 | 100.0 | 100.0 | 10.0 | 71.4 |
| Be | | | | | |
| Cd | | | | | |
| Co | | | | | |
| Cr | 13.7 | 24.8 | 59.1 | 94.2 | 98.8 |
| Cu | 100.0 | 100.0 | 100.0 | 100.0 | 100.0 |
| Mn | −1,667,900.0 | −1,657,900.0 | −1,590,900.0 | −1,029,900.0 | −61,700.0 |
| Ni | 100.0 | 100.0 | 100.0 | 100.0 | 84.4 |
| Pb | | | | | |
| Se | 56.6 | 57.1 | 58.1 | 60.2 | 52.5 |
| V | 100.0 | 100.0 | 100.0 | 100.0 | 99.9 |
| Zn | 100.0 | 100.0 | 100.0 | 100.0 | 98.4 |

TABLE 23 illustrates the effect of precipitation pH on the removal of trace elements from the leachate of fly ash sample F4. Here, As, Cu, Se and V did not show any change with a change in precipitation pH, while the removal efficiency of Cr evidenced a direct relationship.

Precipitation times of 10, 30, 60, 90 and 140 min. were additional parameters studied under conditions of 8.0 g/L $FeSO_4.7H_2O$ for F2 and 6.0 g/L for F4, with 2.0 hours redox time, 2.0 redox pH, and 2.0 precipitation pH.

TABLE 24

| Trace Elements | Removal % | | | | |
|---|---|---|---|---|---|
| | 10.0 min | 30.0 min | 60.0 min | 90.0 min | 140.0 min |
| Ag | | | | | |
| As | 99.6 | 99.9 | 100.0 | 100.0 | 100.0 |

TABLE 24-continued

| Trace Elements | Removal % | | | | |
|---|---|---|---|---|---|
| | 10.0 min | 30.0 min | 60.0 min | 90.0 min | 140.0 min |
| B | 10.8 | 8.5 | 6.1 | 8.7 | 7.6 |
| Ba | 100.0 | 100.0 | 100.0 | 100.0 | 100 |
| Be | | | | | |
| Cd | | | | | |
| Co | | | | | |
| Cr | 67.7 | 64.3 | 61.5 | 60.9 | 60.3 |
| Cu | 100.0 | 100.0 | 100.0 | 100.0 | 100.0 |
| Mn | −37,880.8 | −38,630.8 | −4,226.9 | −38,284.6 | −38,438.5 |
| Ni | 100.0 | 100.0 | 100.0 | 100.0 | 100.0 |
| Pb | | | | | |
| Se | 57.9 | 58.8 | 62.0 | 59.7 | 60.1 |
| V | 97.8 | 97.8 | 97.2 | 97.9 | 97.9 |
| Zn | 100.0 | 100.0 | 100.0 | 100.0 | 100.0 |

TABLE 25

| Trace Elements | Removal % | | | | |
|---|---|---|---|---|---|
| | 10.0 min | 30.0 min | 60.0 min | 90.0 min | 165.0 min |
| Ag | | | | | |
| As | 100.0 | 100.0 | 100.0 | 100.0 | 100.0 |
| B | 12.9 | 10.4 | 8.1 | 6.7 | 8.7 |
| Ba | 100.0 | 100.0 | 100.0 | 100.0 | 100.0 |
| Be | | | | | |
| Cd | | | | | |
| Co | | | | | |
| Cr | 74.2 | 74.6 | 74.7 | 75.3 | 74.4 |
| Cu | 100.0 | 100.0 | 100.0 | 100.0 | 100.0 |
| Mn | −1,526,900.0 | −1,546,900.0 | −1,576,900.0 | −1,592,900.0 | −1,569,900.0 |
| Ni | 100.0 | 100.0 | 100.0 | 100.0 | 100.0 |
| Pb | | | | | |
| Se | 88.9 | 92.8 | 90.7 | 90.5 | 88.4 |
| V | 100.0 | 100.0 | 100.0 | 100.0 | 100.0 |

It is clear from TABLES 24 and 24 for the two fly ash sample F2, and F4. respectively, that there were no significant effects of precipitation time on all trace elements leached from both fly ash samples F2 and F4, in the range of the studied time.

2. Treatment with $FeCl_2.4H_2O$:

Another multifunctional agent was used in this research to remove the heavy and trace elements from the leachate of the four fly ash samples F1-F4. TABLE 26 shows adsorption results using $FeCl_2.4H_2O$, following the same simple procedure as with the previous multifunctional agent at the random $FeCl_2.4H_2O$ dosage of 9.0 g/L.

TABLE 26

| Trace | Removal % | | | |
|---|---|---|---|---|
| Elements | F1 | F2 | F3 | F4 |
| Ag | | | | |
| As | 100.0 | 100.0 | 100.0 | 100.0 |
| B | 20.6 | 16.3 | 45.5 | 17.6 |
| Ba | 100.0 | 100.0 | 100.0 | 100.0 |
| Be | | | | |
| Cd | | | | |
| Co | 100.0 | 100.0 | 100.0 | 100.0 |
| Cr | 88.7 | 98.8 | 100.0 | 82.0 |
| Cu | 100.0 | 100.0 | 100.0 | 100.0 |
| Mn | | | | |
| Ni | | | | |
| Pb | | | | |
| Se | 82.7 | 90.0 | 97.0 | 98.3 |
| V | 100.0 | 97.6 | 100.0 | 100.0 |
| Zn | 100.0 | 100.0 | 100.0 | 100.0 |

Based on its ability to remove trace elements from the leachate of the four fly ash samples (F1 to F4) as shown in TABLE 26, $FeCl_2.4H_2O$ is an effective multifunctional agent with all fly ash samples investigated, with a removal efficiency for Se ranging between 82.7% for F1 up to 98.0% for F4; other trace elements (As, Cu, Cr and V) showed a removal efficiency of nearly 100%.

Three $FeCl_2.4H_2O$ dosages (9.0, 11.0, and 13.0 g/L) were used to demonstrate the effect of multifunctional agent dosage on reducing trace and heavy elements leached from the fly ash samples. Investigations were conducted under the conditions of redox pH=2.0, redox time=2.0 h, precipitation pH=8.0, and precipitation time=1 h to evaluate the effect of the multifunctional $FeCl_2.4H_2O$ dosages on the reduction of the trace and heavy elements from the leachate of fly ash sample F1, and the results are shown in TABLE 27.

TABLE 27

| | Removal % $FeCl_2 \cdot 4H_2O$ dosage (g/L) | | |
|---|---|---|---|
| Trace Elements | 9.0 | 11.0 | 13.0 |
| Ag | | | |
| As | 100.0 | 100.0 | 100.0 |
| B | 21.0 | 18.5 | 32.1 |
| Ba | 100.0 | 100.0 | 100.0 |
| Be | | | |
| Cd | | | |
| Co | 100.0 | 100.0 | 100.0 |
| Cr | 40.2 | 36.1 | 27.8 |
| Cu | 100.0 | 100.0 | 100.0 |
| Mn | −32,475.0 | −38,050.0 | −47,762.5 |
| Ni | | | |
| Pb | | | |
| Se | 75.8 | 76.5 | 94.6 |

TABLE 27-continued

| | Removal % $FeCl_2 \cdot 4H_2O$ dosage (g/L) | | |
|---|---|---|---|
| Trace Elements | 9.0 | 11.0 | 13.0 |
| V | 100.0 | 100.0 | 100.0 |
| Zn | 100.0 | 100.0 | 100.0 |

The effect of the dosages (9.0, 11.0 and 13.0 g/L) of the multifunctional $FeCl_2.4H_2O$ was evaluated for reducing the trace elements from the leachate of fly ash sample F2 under the conditions of redox pH=2.0, redox time=2.0 h, precipitation pH=8.0, and precipitation time=1 h, and the results are shown in TABLE 28.

TABLE 28

| Trace | Removal % $FeCl_2 \cdot 4H_2O$ dosage (g/L) | | |
|---|---|---|---|
| Elements | 9.0 | 11.0 | 13.0 |
| Ag | | | |
| As | 100.0 | 100.0 | 100.0 |
| B | 14.1 | 15.7 | 13.7 |
| Ba | 100.0 | 100.0 | 100.0 |
| Be | | | |
| Cd | | | |
| Co | 43.2 | 38.6 | 66.5 |
| Cr | 59.4 | 48.9 | 79.8 |
| Cu | 100.0 | 100.0 | 100.0 |
| Mn | −5,320.8 | −6,558.3 | −4,366.7 |
| Ni | | | |
| Pb | | | |
| Se | 88.0 | 90.1 | 93.1 |
| V | 98.3 | 98.5 | 98.7 |
| Zn | 100.0 | 100.0 | 100.0 |

Investigations under the conditions of redox pH=2.0, redox time=2.0 h, precipitation pH=8.0, and precipitation time=1 h were conducted to evaluate the effect of the $FeCl_2.4H_2O$ dosages (9.0, 11.0 and 13.0 g/L) on the reduction of the trace elements from the leachate of fly ash sample F3, and the results are shown in TABLE 29.

TABLE 29

| Trace | Removal % $FeCl_2 \cdot 4H_2O$ dosage (g/L) | | |
|---|---|---|---|
| Elements | 9.0 | 11.0 | 13.0 |
| Ag | | | |
| As | 100.0 | 100.0 | 100.0 |
| B | 27.9 | 49.1 | 43.6 |
| Ba | 100.0 | 100.0 | 100.0 |
| Be | | | |
| Cd | | | |
| Co | | | |
| Cr | 100.0 | 100.0 | 100.0 |
| Cu | 100.0 | 100.0 | 100.0 |
| Mn | −2652.6 | −8994.7 | −11900.0 |
| Ni | | | |
| Pb | | | |
| Se | 83.4 | 96.7 | 98.6 |
| V | 100.0 | 100.0 | 100.0 |
| Zn | 97.6 | 94.6 | 92.3 |

To evaluate the effect of the multifunctional $FeCl_2.4H_2O$ agent dosage on the reduction of the trace elements from the leachate of fly ash sample F4, investigations were conducted under the conditions of redox pH=2.0, redox time=2.0 h, precipitation pH=8.0, and precipitation time=1 h, and $FeCl_2.4H_2O$ dosages of 9.0, 11.0 and 13.0 g/L, and the results are shown in TABLE 30.

TABLE 30

| Trace | Removal % $FeCl_2 \cdot 4H_2O$ dosage (g/L) | | |
|---|---|---|---|
| Elements | 9.0 | 11.0 | 13.0 |
| Ag | | | |
| As | 100.0 | 100.0 | 100.0 |
| B | 8.0 | 11.2 | 11.3 |
| Ba | 100.0 | 100.0 | 100.0 |
| Be | | | |
| Cd | | | |
| Co | | | |
| Cr | 100.0 | 100.0 | 100.0 |
| Cu | 100.0 | 100.0 | 100.0 |
| Mn | | | |
| Ni | | | |
| Pb | | | |
| Se | 98.1 | 98.8 | 99.1 |
| V | 99.9 | 99.9 | 99.8 |
| Zn | 49.6 | 14.2 | 63.8 |

TABLES 27-30 indicate that $FeCl_2.4H_2O$ showed good performance for fly ash samples F1 to F4, respectively. 100% of As, Cr, Cu and V were removed with the lowest $FeCl_2.4H_2O$ dosage (9.0 g/L), while Se removal ranged from greater than 75% for F1 to 99.1% for sample F4. The negative removal percentages of manganese (Mn) shown in TABLES 27-30 indicate the leachability of Mn from the multifunctional agent.

Various parameters were tested to determine the efficiency of the multifunctional agent $FeCl_2.4H_2O$ for removing trace elements from the leachates of fly ash samples F2 and F4, each having differing concentrations of the major elements. (For example, F2 has high concentrations of carbonate (~295 mg/g), while F4 has lower concentrations (~18 mg/g). The effect of redox time on the performance of $FeCl_2.4H_2O$ was studied under conditions of 8.0 g/L $FeCl_2.4H_2O$ for F2 and 6.0 g/L for F4, with a redox pH of 2.0, a precipitation pH of 8.0, and a 1.0 h precipitation time. TABLE 31 shows the results obtained from F2, and TABLE 32 shows the F4 results.

TABLE 31

| Trace | Removal % | | | | |
|---|---|---|---|---|---|
| Elements | 0.5 hour | 1.0 hour | 1.5 hours | 2.0 hours | 3.0 hours |
| Ag | | | | | |
| As | 99.8 | 100.0 | 100.0 | 100.0 | 100.0 |
| B | 0 | 0.3 | 1.5 | 0.1 | 1.6 |
| Ba | 100.0 | 100.0 | 100.0 | 100.0 | 100.0 |
| Be | | | | | |
| Cd | | | | | |
| Co | 46.1 | 47.3 | 35.2 | 79.4 | 47.3 |
| Cr | 91.5 | 89.4 | 86.2 | 97.8 | 87.9 |
| Cu | 100.0 | 100.0 | 100.0 | 100.0 | 100.0 |
| Mn | −36,987.0 | −40,378.3 | −39,617.4 | −29,987.0 | −41,465.2 |
| Ni | 0.0 | 0.0 | 0.0 | 0.0 | 0.0 |
| Pb | | | | | |
| Se | 34.0 | 37.8 | 40.1 | 43.0 | 40.4 |
| V | 97.0 | 97.3 | 97.6 | 97.3 | 97.4 |
| Zn | 100.0 | 100.0 | 100.0 | 100.0 | 100 |

TABLE 32

| Trace | Removal % | | | | |
|---|---|---|---|---|---|
| Elements | 0.5 hour | 1.0 hour | 1.5 hours | 2.0 hours | 3.0 hours |
| Ag | | | | | |
| As | 100.0 | 100.0 | 100.0 | 100.0 | 100.0 |
| B | 9.6 | 11.9 | 9.6 | 9.3 | 10.7 |
| Ba | 100.0 | 100.0 | 100.0 | 100.0 | 100.0 |
| Be | | | | | |
| Cd | | | | | |
| Co | | | | | |
| Cr | 92.6 | 93.4 | 98.5 | 97.2 | 97.5 |
| Cu | 100.0 | 100.0 | 100.0 | 100.0 | 100.0 |
| Mn | | | | | |
| Ni | | | | | |
| Pb | | | | | |
| Se | 97.3 | 97.9 | 95.5 | 96.0 | 95.0 |
| V | 100.0 | 100.0 | 100.0 | 100.0 | 100.0 |
| Zn | 100.0 | 100.0 | 100.0 | 100.0 | 100.0 |

TABLE 31 shows that, for fly ash sample F2, more than 97% of As, Cu and V were removed completely at all redox times tested in this study, while the removal efficiencies of Cr and Se were affected slightly with increased redox time indicating that the $FeCl_2.4H_2O$ is cost-effective, and a fast heavy metal adsorbent.

TABLE 33 shows the effect of redox pH on fly ash sample F2, and TABLE 34 shows the results for sample F4 under conditions of 9.0 g/L $FeCl_2.4H_2O$ for F2 and 6.0 g/L for F4, 2.0 h redox time, a precipitation pH of 8.0, and 1.0 h precipitation time.

TABLE 33

| Trace | Removal % | | | | |
|---|---|---|---|---|---|
| Elements | pH 1.0 | pH 2.0 | pH 3.0 | pH 4.0 | pH 5.0 |
| Ag | | | | | |
| As | 100.0 | 100.0 | 99.9 | 100.0 | 99.8 |
| B | 6.0 | 6.8 | 6.9 | 6.1 | 7.0 |
| Ba | 100.0 | 100.0 | 100.0 | 100.0 | 100.0 |
| Be | | | | | |
| Cd | | | | | |
| Co | 77.0 | 67.4 | 86.5 | 81.5 | 82.0 |
| Cr | 100.0 | 100.0 | 100.0 | 100.0 | 100.0 |
| Cu | 100.0 | 100.0 | 100.0 | 100.0 | 100.0 |
| Mn | −4,494.2 | −4,790.4 | −3,378.8 | −4,226.9 | −4,167.3 |
| Ni | | | | | |
| Pb | | | | | |
| Se | 64.3 | 63.5 | 62.1 | 62.0 | 59.8 |
| V | 97.5 | 97.6 | 97.6 | 97.2 | 97.3 |
| Zn | 100.0 | 100.0 | 100.0 | 100.0 | 100.0 |

TABLE 34

| Trace | Removal % | | | | |
|---|---|---|---|---|---|
| Elements | pH 1.0 | pH 2.0 | pH 3.0 | pH 4.0 | pH 5.0 |
| Ag | | | | | |
| As | 98.6 | 99.7 | 99.6 | 99.8 | 100.0 |
| B | 6.9 | 8.8 | 7.5 | 8.1 | 6.9 |
| Ba | 100.0 | 100.0 | 100.0 | 100.0 | 100.0 |
| Be | | | | | |
| Cd | | | | | |
| Co | | | | | |
| Cr | 100.0 | 100.0 | 100.0 | 100.0 | 100.0 |
| Cu | 100.0 | 100.0 | 100.0 | 100.0 | 100.0 |
| Mn | #DIV/0! | #DIV/0! | #DIV/0! | #DIV/0! | #DIV/0! |
| Ni | | | | | |
| Pb | | | | | |

TABLE 34-continued

| Trace Elements | Removal % pH 1.0 | pH 2.0 | pH 3.0 | pH 4.0 | pH 5.0 |
|---|---|---|---|---|---|
| Se | 63.9 | 71.1 | 69.3 | 70.1 | 68.1 |
| V | 99.4 | 99.6 | 99.6 | 99.6 | 99.6 |
| Zn | 63.6 | 47.9 | 67.9 | 56.4 | 53.6 |

Results shown in TABLE 33, for fly ash sample F2 illustrate that As, Cr, Cu, and V removal efficiencies were 100%, while Se removal efficiency decreased slightly with increasing in redox pH. The results shown in TABLE 34 are for fly ash sample F4 and show 100% removal efficiencies for As, Cr, Cu and V, while B, Se and Zn removal efficiencies were not affected with changes in redox pH.

Five precipitation pH values ranging from 5.0 to 9.0 were tested under conditions of 9.0 g/L $FeCl_2.4H_2O$ for F2 and 6.0 g/L for F4, 2.0 h redox time, 2.0 redox pH and 1.0 h precipitation time, to determine the effect of precipitation pH on the performance of $FeCl_2.4H_2O$. TABLE 35 shows the results for fly ash sample F2, and TABLE 36 shows the results for sample F4.

TABLE 35

| Trace Elements | Removal % pH 5.0 | pH 6.0 | pH 7.0 | pH 8.0 | pH 9.0 |
|---|---|---|---|---|---|
| Ag | | | | | |
| As | 100.0 | 100.0 | 100.0 | 100.0 | 98.5 |
| B | 10.0 | 9.8 | 9.1 | 7.9 | 1.2 |
| Ba | 100.0 | 100.0 | 100.0 | 100.0 | 100.0 |
| Be | | | | | |
| Cd | | | | | |
| Co | | | | | |
| Cr | | | | | |
| Cu | 100.0 | 100.0 | 100.0 | 100.0 | 100.0 |
| Mn | −5,289.8 | −5,313.6 | −5,305.1 | −5,178.0 | −71.2 |
| Ni | 100.0 | 100.0 | 100.0 | 100.0 | 96.6 |
| Pb | | | | | |
| Se | 40.0 | 39.7 | 40.6 | 45.8 | 43.0 |
| V | 100.1 | 101.1 | 100.7 | 98.9 | 97.7 |
| Zn | 100.0 | 100.0 | 100.0 | 100.0 | 85.8 |

TABLE 35 shows results for fly ash sample F2. As and Cu removal efficiencies were 100% at all precipitation pH values, while V removal efficiency was 100% at pH 5.0, 6.0 and 7.0, and then decreased with increases in precipitation pH (i.e., pH 8.0 and 9.0). Se removal efficiency was not significantly affected by a change in precipitation pH, although highest Se removal was at precipitation pH of 8.0.

TABLE 36

| Trace Elements | Removal % pH 5.0 | pH 6.0 | pH 7.0 | pH 8.0 | pH 9.0 |
|---|---|---|---|---|---|
| Ag | | | | | |
| As | 100.0 | 100.0 | 100.0 | 100.0 | 100.0 |
| B | 12.8 | 9.6 | 9.3 | 9.6 | 3.9 |
| Ba | 100.0 | 100.0 | 100.0 | 100.0 | 74.6 |
| Be | | | | | |
| Cd | | | | | |
| Co | | | | | |
| Cr | 100.0 | 100.0 | 100.0 | 92.8 | 96.0 |
| Cu | 100.0 | 100.0 | 100.0 | 100.0 | 100.0 |
| Mn | #DIV/0! | #DIV/0! | #DIV/0! | #DIV/0! | #DIV/0! |
| Ni | | | | | |
| Pb | | | | | |
| Se | 69.9 | 67.0 | 91.8 | 93.2 | 56.7 |
| V | 100.0 | 100.0 | 100.0 | 99.8 | 99.8 |
| Zn | 100.0 | 100.0 | 100.0 | 100.0 | 100.0 |

TABLE 36 shows results obtained for fly ash sample F4, in which As, Cu and V removal efficiencies were 100% at all precipitation pH values. Se removal efficiency was affected significantly by changes in precipitation pH, with the best Se removal efficiencies at precipitation pH 7.0 and 8.0. (At low and very high pH levels, the Se was dissolved in the solution).

In order to determine the effect of precipitation time on its performance, $FeCl_2.4H_2O$ was studied over time periods of 10, 30, 60, 90 and 120 min. for fly ash sample F2; and over 10, 30, 60, 110 and 160 min. for sample F4, under conditions of 9.0 g/L $FeCl_2.4H_2O$ for F2 and 6.0 g/L for F4, 2.0 h redox time, a redox pH of 2.0, and a precipitation pH of 8.0. TABLE 37 shows results for sample F2, and TABLE 38 shows results for F4.

TABLE 37

| Trace Elements | Removal % 10.0 min | 30.0 min | 60.0 min | 90.0 min | 120.0 min |
|---|---|---|---|---|---|
| Ag | | | | | |
| As | 100.0 | 100.0 | 100.0 | 100.0 | 100.0 |
| B | 8.4 | 8.5 | 10.6 | 7.0 | 7.5 |
| Ba | 100.0 | 100.0 | 100.0 | 100.0 | 100.0 |
| Be | | | | | |
| Cd | | | | | |
| Co | | | | | |
| Cr | | | | | |
| Cu | 100.0 | 100.0 | 100.0 | 100.0 | 100.0 |
| Mn | −5,116.7 | −5,145.0 | −5,090.0 | −5,193.3 | −5,210.0 |
| Ni | | | | | |
| Pb | | | | | |
| Se | 44.2 | 44.3 | 47.1 | 43.0 | 41.8 |
| V | 98.8 | 98.8 | 98.9 | 98.8 | 98.8 |
| Zn | 100.0 | 100.0 | 100.0 | 100.0 | 100.0 |

TABLE 38

| Trace Elements | Removal % 10.0 min | 30.0 min | 60.0 min | 110.0 min | 160.0 min |
|---|---|---|---|---|---|
| Ag | | | | | |
| As | 100.0 | 100.0 | 100.0 | 100.0 | 100.0 |
| B | 11.8 | 10.0 | 6.6 | 6.5 | 5.3 |
| Ba | 100.0 | 100.0 | 100.0 | 100.0 | 100.0 |
| Be | | | | | |
| Cd | | | | | |
| Co | | | | | |

TABLE 38-continued

| Trace Elements | Removal % 10.0 min | 30.0 min | 60.0 min | 110.0 min | 160.0 min |
|---|---|---|---|---|---|
| Cr | 85.4 | 86.3 | 87.0 | 87.7 | 86.8 |
| Cu | 100.0 | 100.0 | 100.0 | 100.0 | 100.0 |
| Mn | −160,800.0 | −165,200.0 | −174,800.0 | −177,800.0 | −182,500.0 |
| Ni | | | | | |
| Pb | | | | | |
| Se | 95.1 | 95.7 | 95.6 | 96.0 | 95.3 |
| V | 100.0 | 100.0 | 100.0 | 100.0 | 100.0 |
| Zn | 63.8 | 57.7 | 59.5 | 39.1 | 58.9 |

Data collected for fly ash F2 (TABLE 37) show there was no significant effect of precipitation time on $FeCl_2.4H_2O$ performance. And, as TABLE 38 indicates, there was no significant effect of precipitation time on $FeCl_2.4H_2O$ performance in sample F4.

3. Leached Trace Elements from Multifunctional Agents:

TABLE 39 shows leached trace elements from the two multifunctional agents, $FeSO_4.7H_2O$ and $FeCl_2.4H_2O$. The only element that leached from the two multifunctional agents was Mn, at 9.0 g/L of both multifunctional agents.

TABLE 39

| | DI water | DI water + $FeSO_4 \bullet 7H_2O$ | DI water + $FeCl_2 \bullet 4H_2O$ |
|---|---|---|---|
| Ag | 0.0 | 0.0 | 0.0 |
| As | 0.0 | 0.0 | 0.0 |
| B | 0.057 | 0.00 | 0.0 |
| Ba | 0.001 | 0.00 | 0.00 |
| Be | 0.0 | 0.00 | 0.00 |
| Cd | 0.0 | 0.00 | 0.00 |
| Co | 0.0 | 0.00 | 0.00 |
| Cr | 0.0 | 0.00 | 0.00 |
| Cu | 0.005 | 0.000 | 0.00 |
| Mn | 0.0 | 1.393 | 0.321 |
| Ni | 0.0 | 0.0 | 0.00 |
| Pb | 0.0 | 0.000 | 0.00 |
| Se | 0.0 | 0.00 | 0.00 |
| V | 0.0 | 0.0 | 0.0 |
| Zn | 0.004 | 0.00 | 0.00 |

From TABLE 39, the negative removal percent values for manganese in most of the fly ash sample treatment results may be interpreted as the leaching of Mn in the highest concentrations from both multifunctional agents, particularly, $FeSO_4.7H_2O$.

From the graphs set forth hereinabove, the efficiency of $FeSO_4.7H_2O$ is seen to be greater than that of $FeCl_2.4H_2O$ in reducing the total concentration of As, Cr, Se and V from the leachates of the four fly ash samples F1-F4.

D. Reduction and Adsorption at High pH:

The multifunctional agents $FeSO_4.7H_2O$ and $FeCl_2.4H_2O$ were investigated at high leachate pH for the adsorption test at room temperature (23° C.±2° C.), and at the original leachate pH ≥10. Only the two fly ash samples: F2, with high carbonate content, and F4, with low carbonate content, were investigated, with each test being conducted twice.

1. Treatment with $FeSO_4.7H_2O$:

TABLE 40 shows the results at a randomly chosen $FeSO_4.7H_2O$ dosage (11.0 g/L) for unadjusted pH (i.e. pH >10.0) leachates of F2, and F4, a test time of two weeks at room temperature (23° C.±2° C.). The elements As, Cr, Se and V were determined.

TABLE 40

| Trace element | Removal % F2 | F4 |
|---|---|---|
| As | 93.3 | 100 |
| Cr | 100.0 | 100 |
| Se | 40.7 | 70.6 |
| V | 97.0 | 100 |

TABLE 40 illustrates the removal efficiency of the four elements, from fly ash samples F2, and F4. One may observe that the removal of As, Cr and V was greater than 93% for both fly ash samples F2 and F4. However, the removal efficiency of selenium differed significantly from F2 to F4. At this low dosage, after two weeks more than 70% of Selenium was removed from fly ash sample F4, which has low levels of carbonate and bicarbonate (18 and 22 mg/g, respectively). By contrast, selenium removal from fly ash sample F2, which has high levels of carbonate and bicarbonate (295 and 66 mg/g, respectively), did not exceed 41% under the same test conditions, indicating that carbonate and bicarbonate hamper selenium removal.

Different dosages were used to study the effects of $FeSO_4.7H_2O$ on the reduction of trace elements from the leachates of fly ash samples F2 and F4.

Four dosage levels (20, 25, 30 and 40 g/L) were used to study the effects of $FeSO_4.7H_2O$ on the reduction of trace elements leached from fly ash sample F2 after 5 weeks, with results shown in TABLE 41.

TABLE 41

| Removal % | dosage (g/L) 20 | 25 | 30 | 40 |
|---|---|---|---|---|
| As | 99.6 | 99.7 | 99.8 | 99.8 |
| Cr | 99.4 | 100.0 | 100.0 | 100.0 |
| Se | 33.5 | 40.9 | 44.5 | 54.0 |
| V | 99.7 | 99.8 | 99.9 | 99.9 |

Table 41 shows that removal rates of the trace elements As, Cr, and V were not significantly affected by the dosage levels of multifunctional agent $FeSO_4.7H_2O$, with nearly 100% removal at the lowest administered dose. However, Se removal was affected significantly with changes in $FeSO_4.7H_2O$ dosage, increasing from 33% to 54% when the dosage increased from 20 g/L to 40 g/L after five weeks.

Four dosage levels (15, 20, 30 and 40 g/L) were used to study the effects of $FeSO_4.7H_2O$ on the reduction of trace elements leached from fly ash sample F4 after 3 weeks, at room temperature (23° C.±2° C.), with results shown in TABLE 42.

TABLE 42

| Removal % | dosage (g/L) 15 | 20 | 30 | 40 |
|---|---|---|---|---|
| As | 100 | 100 | 100 | 100 |
| Cr | 100 | 100 | 100 | 100 |
| Se | 62.6 | 63.7 | 65.7 | 67.7 |
| V | 100 | 100 | 100 | 100 |

TABLE 42 illustrates that the removal of the four trace elements was not significantly affected by the dosage level of $FeSO_4.7H_2O$; As, Cr and V experienced 100% removal at the lowest dosage, while Se was not significantly affected by any change in dosage (that is, the increase in removal was only about 5% when the dosage increased from 15 g/L to 40 g/L over three weeks).

The effect of $FeSO_4.7H_2O$ treatment time was tested over periods ranging from one to five weeks, at conditions of 15 g/L and 11.0 g/L $FeSO_4.7H_2O$ for F2 and F4, respectively, and treatment pH of 10.50±0.5 at room temperature 24° C.±2° C. TABLE 43 shows the results from sample F2, and TABLE 44 shows results from sample F4.

TABLE 43

| | Removal % 2 days | 1 Week | 2 Weeks | 3 Weeks |
|---|---|---|---|---|
| As | 95.6 | 99.4 | 99.4 | 99.4 |
| Cr | 100.0 | 100.0 | 100.0 | 100.0 |
| Se | 4.6 | 26.0 | 34.4 | 39.4 |
| V | 98.6 | 98.9 | 99.0 | 99.0 |

TABLE 44

| | Removal % 1 day | 1 Week | 2 Weeks | 3 Weeks | 4 Weeks | 5 Weeks |
|---|---|---|---|---|---|---|
| As | 100.0 | 100.0 | 100.0 | 100.0 | 100.0 | 100.0 |
| Cr | 100.0 | 100.0 | 100.0 | 100.0 | 100.0 | 100.0 |
| Se | 55.6 | 56.4 | 70.6 | 91.7 | 97.1 | 99.0 |
| V | 100.0 | 100.0 | 100.0 | 100.0 | 100.0 | 100.0 |

TABLE 43 indicates the effects of removal time (redox and precipitation time) for fly ash sample F2, showing removal of more than 97% of As, Cr and V after two days at high pH. By contrast, selenium was removed only gradually, starting with about 5% removal in the first two days, and then gradually increasing to 39.4% removal after three weeks. For sample F4, TABLE 44 shows that 100% of As, Cr and V were removed from the first day at high pH; selenium was removed gradually, with more than 50% removal after one day and increasing to 99% after five weeks.

2. Treatment of F2 with $FeCl_2.4H_2O$:

$FeCl_2.4H_2O$ was used for all fly ash samples for the leachate treatment showed very good removal efficiency at low pH. However, it did not show a good response when used at high pH for fly ash sample F2, which has a high carbonate and bicarbonate content (295 and 66 mg/g, respectively).

The effect of $FeCl_2.4H_2O$ treatment time on fly ash sample F2 was tested over different periods, ranging from one week to four weeks, and at conditions of 30 g/L $FeCl_2.4H_2O$, treatment pH of 10.50±0.5 and room temperature of 24° C.±2° C. TABLE 45 shows the results from fly ash sample F2 treated with $FeCl_2.4H_2O$, which removed more than 48% of the Se in fly ash sample F2 after three weeks, indicating that $FeCl_2.4H_2O$ is better than $FeSO_4.7H_2O$ in removal of Se since the latter removed less than 40% of Se during the same time period.

TABLE 45

| | Removal % 1 Week | 2 Weeks | 3 Weeks | 4 Weeks |
|---|---|---|---|---|
| As | 99.8 | 99.9 | 99.9 | 100.0 |
| Cr | 100.0 | 100.0 | 100.0 | 100.0 |
| Se | 36.8 | 45.2 | 48.5 | 52.8 |
| V | 99.6 | 100.0 | 100.0 | 100.0 |

Four dosage levels (15, 20, 25 and 30 g/L) were used to study the effects of $FeCl_2.4H_2O$ dosage on the reduction of trace elements leached from F2 fly ash samples at pH >10 and room temperature of 24° C.±2° C. TABLE 46 shows results after five weeks.

TABLE 46

| Removal % | dosage (g/L) 15 | 20 | 25 | 30 |
|---|---|---|---|---|
| As | 99.3 | 99.6 | 99.7 | 99.8 |
| Cr | 98.9 | 99.5 | 100 | 100.0 |
| Se | 31.3 | 45.9 | 50.0 | 52.7 |
| V | 98.9 | 99.8 | 99.8 | 99.8 |

TABLE 46 shows trace element removal from fly ash sample F2 leachate. About 100% of As, Cr and V was removed at all $FeCl_2.4H_2O$ dosages investigated, while Se was affected significantly with any change in $FeCl_2.4H_2O$ dosage; that is, removal increased from 31% to about 53% when the dosage increased from 15 g/L to 30 g/L after five weeks.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for removing at least one element from fly ash, comprising:

treating said fly ash with an acidified liquid;

allowing the acidified liquid to become basic by reaction with said fly ash, forming a basified liquid;

dissolving at least one ferrous compound in the basified liquid, forming a precipitate of the ferrous compound, whereby said at least one element is sequestered by the precipitate; and separating the precipitate from the basified liquid.

2. The method of claim 1, wherein the at least one ferrous compound is chosen from ferrous chloride, a hydrated form of ferrous chloride, ferrous sulfate, and a hydrated form of ferrous sulfate.

3. The method of claim 2, wherein said hydrated ferrous chloride comprises $FeCl_2.4H_2O$.

4. The method of claim 2, wherein said hydrated ferrous sulfate comprises $FeSO_4.7H_2O$.

5. The method of claim 1, wherein said at least one element comprises selenium.

6. The method of claim 1, wherein said at least one element comprises arsenic.

7. The method of claim 1, wherein said at least one element comprises a heavy metal.

8. The method of claim 7, wherein the heavy metal is chosen from silver, barium, cadmium, cobalt, chromium, copper, manganese, nickel, lead, vanadium, and zinc.

9. The method of claim 1, wherein the acidified liquid has a pH ≤5.

10. The method of claim 1, wherein the acidified liquid has a pH ≤2.

11. The method of claim 1, wherein said fly ash comprises materials chosen from trona, carbonate, bicarbonate, and limestone.

12. The method of claim 11, wherein said fly ash comprises $Na_2CO_3/NaHCO_3$/trona.

13. A method for removing at least one element from fly ash, comprising:

treating said fly ash with an acidified liquid comprising at least one soluble ferrous compound;

allowing the acidified liquid to become basic by reaction with said fly ash;

whereby a precipitate of the ferrous compound is formed, said precipitate sequestering said at least one element; and separating the precipitate from the basic liquid.

14. The method of claim 13, wherein the at least one ferrous compound is chosen from ferrous chloride, a hydrated form of ferrous chloride, ferrous sulfate, and a hydrated form of ferrous sulfate.

15. The method of claim 14, wherein said hydrated ferrous chloride comprises $FeCl_2.4H_2O$.

16. The method of claim 14, wherein said hydrated ferrous sulfate comprises $FeSO_4.7H_2O$.

17. The method of claim 13, wherein said at least one element comprises selenium.

18. The method of claim 13, wherein said at least one element comprises arsenic.

19. The method of claim 13, wherein said at least one element comprises a heavy metal.

20. The method of claim 19, wherein the heavy metal is chosen from silver, barium, cadmium, cobalt, chromium, copper, manganese, nickel, lead, vanadium, and zinc.

21. The method of claim 13, wherein the acidified liquid has a pH ≤5.

22. The method of claim 13, wherein the acidified liquid has a pH ≤2.

23. The method of claim 13, wherein said fly ash comprises materials chosen from trona, carbonate, bicarbonate, and limestone.

24. The method of claim 23, wherein said fly ash comprises $Na_2CO_3/NaHCO_3$/trona.

* * * * *